United States Patent [19]

Twitchell et al.

[11] 4,243,147

[45] Jan. 6, 1981

[54] THREE-DIMENSIONAL LIFT

[76] Inventors: Brent L. Twitchell, 3451 W. - 4400 S., Granger, Utah 84120; Kendel S. Twitchell, 1569 Shenandoah Cr., Murray, Utah 84107

[21] Appl. No.: 19,865

[22] Filed: Mar. 12, 1979

[51] Int. Cl.[3] ..... B66C 17/06

[52] U.S. Cl. ..... 212/159; 5/89; 104/89; 104/172 R; 212/221; 212/206; 212/215; 414/921

[58] Field of Search ..... 212/14, 18, 20, 21, 212/22, 23, 24, 26, 27; 5/85, 86, 89; 104/89, 172 R, 236, 237; 414/921

[56] References Cited

U.S. PATENT DOCUMENTS

| | | | |
|---|---|---|---|
| 687,633 | 11/1901 | Kammerer | 212/27 |
| 2,272,788 | 2/1942 | Reuter | 5/85 |
| 3,937,151 | 2/1976 | Monks | 104/236 X |
| 4,003,479 | 1/1977 | Reyer | 414/921 X |
| 4,125,908 | 11/1978 | Vail et al. | 212/18 X |

FOREIGN PATENT DOCUMENTS

| | | | |
|---|---|---|---|
| 786193 | 11/1957 | United Kingdom | 104/89 |
| 1092926 | 11/1967 | United Kingdom | 104/89 |

*Primary Examiner*—L. J. Paperner

*Attorney, Agent, or Firm*—M. Reid Russell

[57] ABSTRACT

A three-dimensional lift intended for use by a handicapped person, providing him with three dimensions of mobility within a room or rooms. The invention consists of uniform channels or rails secured in parallel configuration adjacent to or on a room ceiling with a traveling bridge arranged to traverse the length of the channels, and incorporates with the bridge a head mounted to travel thereacross spanning the room or rooms with a sling suspended therefrom to move vertically, supporting the handicapped person, and includes a remote control hung from the head, accessable to and giving the handicapped person the capability to operate the device while he is seated in the sling, providing that person with three dimensions of travel that they control. The invention includes two motors that are arranged with the head turning sprockets in fixed chains connecting between the wall channels across the traveling bridge to provide movement of the traveling bridge and head thereacross, with a third motor providing vertical movement of the sling. The motors are preferably operated by a low voltage system, preferably through batteries, to limit a potential for dangerous electrical shock to the handicapped person should the control contact water.

21 Claims, 12 Drawing Figures

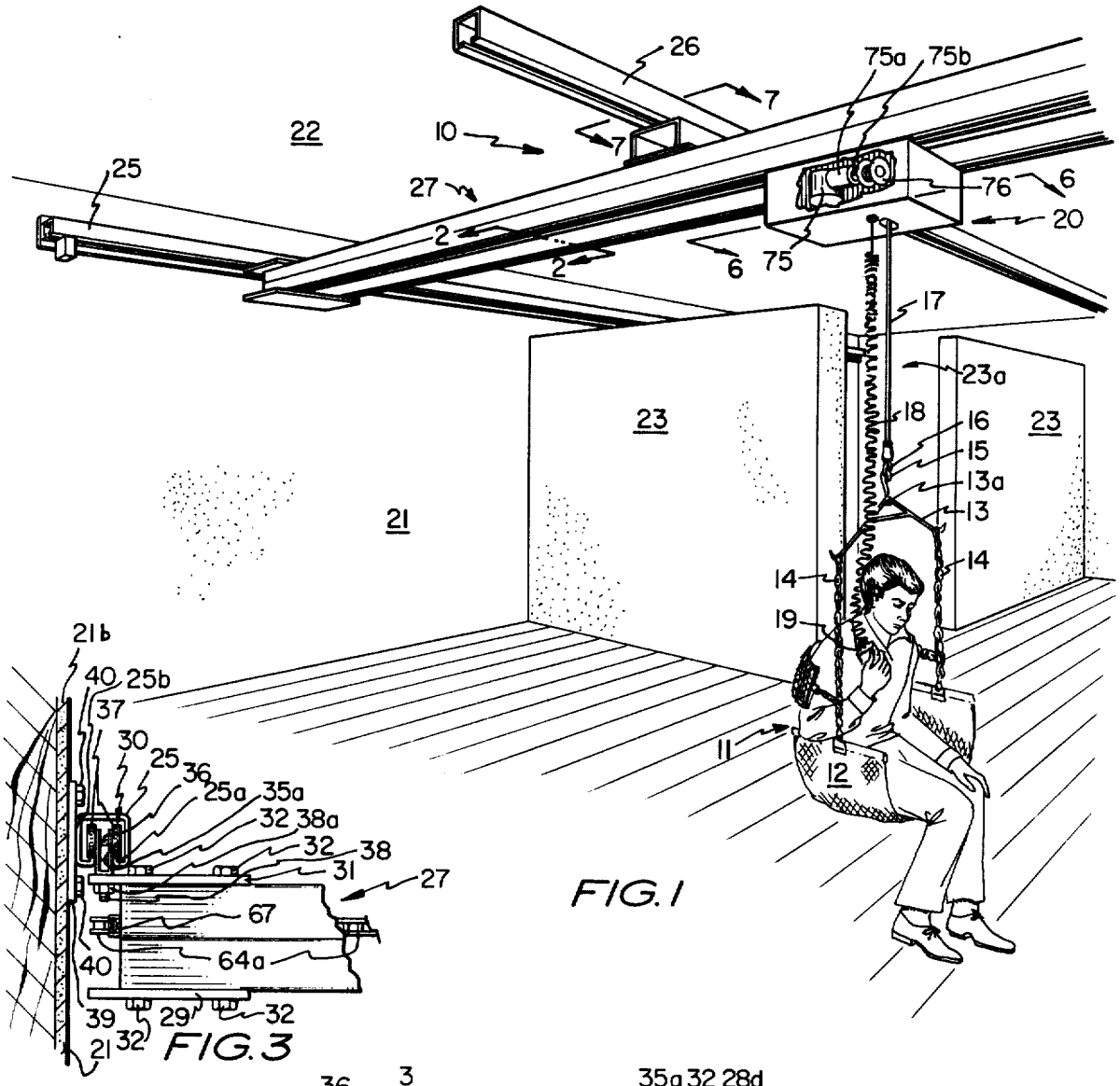
FIG. 1
FIG. 3
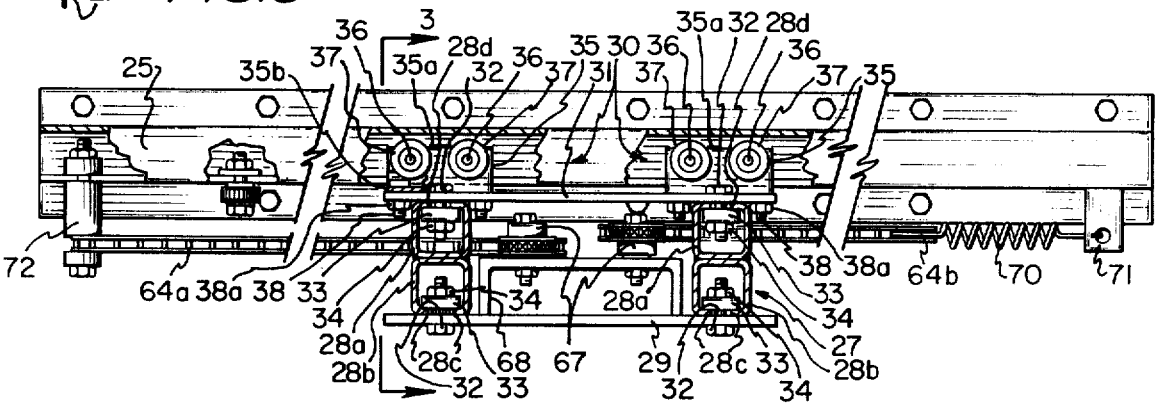
FIG. 2

THREE-DIMENSIONAL LIFT

DESCRIPTION OF THE INVENTION

1. Field of the Invention

This invention relates to lifting systems for use by a handicapped person, providing him with independent mobility within a room or structure.

2. Prior Art

In today's technologically oriented society we are increasingly utilizing mechanical and electrical devices as substitutes for or to correct deficiencies in a human body. Artificial organs are being designed for implant into a human body, substituting for damaged or diseased organs, and new materials are being used to link damaged tendons, repair bones and the like. For the paraplegic and quadraplegic, technological advances are increasingly providing them with independent mobility. The present invention is intended to be such a mechanical/electrical device for providing the handicapped person with independence within his own home or within certain areas within such home. Certainly, self-propelled chairs, powered lifting frames, or the like, are not new and have been heretofore developed to add mobility to the handicapped. However, within the knowledge of the inventors, no device prior to the present invention has provided the handicapped person with a system whereby, in a room or in a combination of rooms such as a bedroom and a bathroom, a handicapped person can provide himself with needed mobility to meet his needs within such confined area without assistance from others. Former devices such as Vail, U.S. Pat. No. 4,125,908, have provided only partial movement solutions, giving a patient only two dimensions of movement, and other arrangements, like devices by Reuter, U.S. Pat. No. 2,272,778, and Reyer, U.S. Pat. No. 4,003,479, have provided frames over beds, assisting a person's movement from a chair into the bed. The present invention is believed to provide a person with sufficient independent movement capability within a defined area to meet all his needs.

While certainly overhead lifts are not new, lifts having capabilities of three dimensions of movement have not heretofore been proposed as people movers and, further, as the present invention is supplied power for its operation from batteries, it cannot produce a dangerous electrical shock to a handicapped person operator even if the control unit or other parts of the device are splashed or immersed in water.

Within the knowledge of the inventors, there has not heretofore existed a device like that of the present invention that provides a simplified and safe patient operated lift having the capability of three dimensions of travel that is simple to construct, electrically safe in its operation and simple to operate. The present invention, therefore, is believed to be both novel and unique and a significant improvement in the art.

SUMMARY OF THE INVENTION

It is the principal object of the present invention in a three-dimensional lift to provide to a handicapped person an electro/mechanical device affording him the capability for moving in three dimensions within a limited area, as say within his home, or the like, with little or no help from another person.

Another object of the present invention in a three-dimensional lift is to provide a device arranged to travel on overhead channels mounted to the walls and/or ceiling of a room or rooms providing a traveling bridge for movement along the channels and including a head arranged to move along that traveling bridge, with a hoist included with the head arranged for lifting a sling wherein a handicapped person is supported, that person controlling operation thereof through a control head that is suspended from that head.

Another object of the present invention in a three dimensional lift is to provide a motive power source for moving the traveling bridge and head, consisting of two electric motors for turning sprockets in fixed chains, whereby, depending on the direction of turning of the motors, the traveling bridge is moved along the channels or the head is moved along the traveling bridge, with a third motor provided for vertically lifting a sling wherein the handicapped person is supported.

Still another object of the present invention in a three dimensional lift is to provide a battery arrangement for supplying low voltage power for driving or turning the electric motors whereby the system can be operated without creating an electrical hazard to a person using and controlling the device.

Still another object of the present invention in a three dimensional lift is to provide a device capable of moving a single person safely in three dimensions that is inexpensive to construct and is strong and reliable and is safe in its operation and provides a handicapped person with independent movement within a defined area.

The principal features of the present invention in a three dimensional lift for providing independent mobility to a handicapped person within a defined area include wall and/or ceiling mounted channels that support a traveling bridge moving therealong, the traveling bridge including free-wheeling trolleys that are arranged to ride or travel along the channels. The channels support the trolley wheels traveling therein and include appropriate stops secured at the ends thereof for confining movement of the traveling bridge. The traveling bridge supports a head arranged to travel thereacross, movement of the traveling bridge and head providing two dimensions of movement. From the head a winch operated cable, or like arrangement, is suspended that is attached to a trapeze bar and patient sling combination whereby a handicapped person can be maintained and can move vertically. The person controls the traveling bridge, head and winch operation through a button operated control box that hangs from the head and is convenient to the handicapped person supported in the sling.

Movement of the traveling bridge and head are provided by operation of two electrical motors secured to the head. The motors each turn a sprocket that meshes into one of two fixed chains. Each chain extends and is secured at its ends between an end of one wall channel, extending across the traveling bridge and is fixed at the opposite end of the other wall channel, the chains crossing one another at the head. By appropriate turning of the electric motors and sprockets in the same or opposite directions, the traveling bridge and head can be individually moved, providing two dimensions of movement, which motor operation is controlled by the handicapped person as he is positioned in the sling suspended from the head. Operation of a third winch motor turning through a transmission or pulley appropriately secured to a cable that is, in turn, appropriately connected to the sling, provides vertical movement of a person in the sling. Operation of the three motors, controlled by the handicapped person, provides for movement in three dimensions without the assistance of another person.

Power to operate the motors is preferably provided from a battery source, as a low voltage therefrom minimizes danger of electrical shock to a person utilizing the device even should the control or components of the invention be splashed with or immersed in water, or the like. As the present invention is preferably battery operated, it preferably includes also an arrangement for attaching a charger thereto such that, when the unit is not in use, the batteries can be charged from a conventional household current.

Other features of the present invention include a flexible or spring coupling of the two chains at their ends to allow for some shock absorbing during operation of the traveling bridge or head. Also, the present invention preferably provides a trolley mount arrangement for supporting one end of the traveling bridge to a wall mounted channel to compensate for a non-even wall surface whereto the channel is attached.

Further objects and features of the present invention in a three dimensional lift will become more apparent from the following detailed description, taken together with the accompanying drawings.

THE DRAWINGS

FIG. 1, is a perspective view taken within a room showing, channels of the present invention in a three dimensional lift installed to the walls and ceilings thereof, a traveling bridge supported thereon wherealong a head is arranged to travel and showing also a handicapped person in a sling suspended from the head holding a control that hangs from that head;

FIG. 2, a sectional view taken along the line 2—2 of FIG. 1, showing in cross-section the traveling bridge end secured to a side trolley that is shown supported in a wall channel secured to the wall proximate to the room ceiling, showing also guide sprockets arranged proximate to the traveling bridge ends that mesh in fixed chains, the two chains shown fixed at their ends to the wall channel ends;

FIG. 3, a sectional view taken along the line 3—3 of FIG. 2, showing the side trolley secured to the end of the traveling bridge to travel along and within the wall channel;

FIG. 4, a top plan schematic view of the present invention including opposite wall channels wherealong the traveling bridge is arranged to travel, showing two chains, each connected at one end to an end of a wall channel, each chain extending across the traveling bridge and secured to the wall channel end, showing drive and idler sprockets on motor and the traveling bridge, respectively, fitted into the chains whereby, by appropriate turning of the motor sprockets, the traveling bridge is moved along the wall channels with the head moved thereacross, providing two dimensions of movement;

FIGS. 5(*a*) through 5(*d*) are expanded schematic views taken within the lines 5—5 of FIG. 4 showing the head with motor and idler sprockets extending therefrom, with curved arrows showing the different directions of turning of the driver motor sprockets, resulting, as shown by lettered straight arrow, in movement of the traveling bridge and head, which movement is dependent upon the direction of the turning of each motor sprocket relative to the other motor sprocket;

FIG. 6, a sectional view taken along the line 6—6 of FIG. 1, showing in a side elevation view the head with motors secured to extend outwardly from the top thereof wherefrom drive shafts are journaled with sprockets thereon, the motor sprockets and idler sprockets meshing in fixed chains to travel therealong with arrows indicating the direction of movement of the motor sprockets and idler sprockets along the respective fixed chain;

FIG. 7, a sectional view taken along the line 7—7 of FIG. 1, showing, in cross section, a roof channel wherein a channel trolley is shown arranged to roll, the channel trolley mounts, at a normal angle, a traveling bridge support trolley with rollers thereof supported in a top channel of a double channel of the traveling bridge;

FIG. 8, a view like that of FIG. 3 only showing a traveling bridge side support trolley, rollers thereof arranged in the top channel of the double channel of the traveling bridge, mounted at a normal angle thereacross, providing thereby for a lateral movement of the traveling bridge as it moves along a wall channel that is secured to an uneven wall, or the like; and FIG. 9, an electrical schematic of a preferred control arrangement for connecting a battery source of electrical energy to the electrical motors of the present invention.

DETAILED DESCRIPTION

Figure 4:
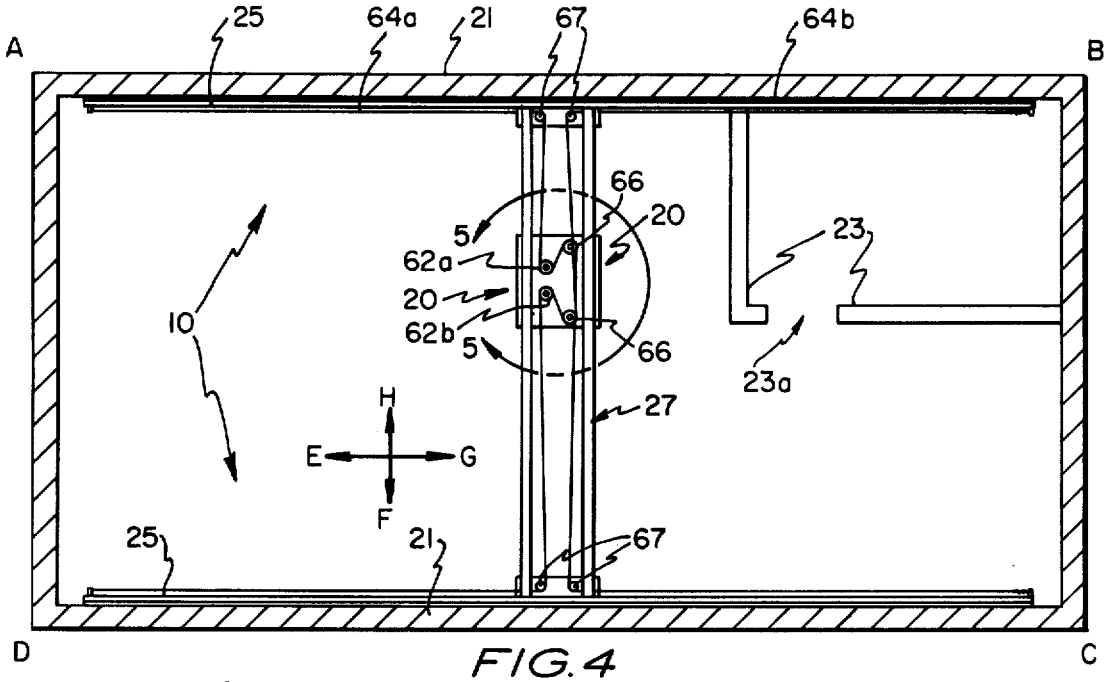

Referring now to the drawings:

In FIG. 1 is shown a perspective view of a preferred embodiment of the present invention in a three dimensional lift 10, hereinafter referred to as "lift," shown installed in a room within walls 21 for providing independent mobility throughout that room and, as shown, an adjoining room within walls 23 to a handicapped person 11. Handicapped person 11 is shown seated in a sling 12 that is suspended from a trapeze bar 13 by chains 14, or the like. The trapeze bar is supported at an apex 13*a* thereof to a hook 15 that is fitted through an eyelet 16 formed in an end of cable 17, or the like, that extends downwardly from a head 20 of lift 10. Also hanging from head 20 is shown a coiled cable 18, that should be taken as being an electrical cable, whereto is connected to a control box 19 that handicapped person 11 is shown holding.

Handicapped person 11 should be taken as being a person who has suffered a certain loss of mobility due to injury, disease or the like, the lift 10 of the present invention substituting somewhat for his loss of mobility, providing him three dimensions of movement within a confined area like that shown between walls 21 in FIG. 1.

In FIG. 1 the lift 10 is shown secured to the room walls 21, proximate to a ceiling 22, with divider walls 23 shown therein as representing a separate area such as a bathroom, or the like. The top portions of walls 23 are shown removed to allow for travel of a traveling bridge 27 thereover with a handicapped patient 11 suspended from head 20 traveling through an opening 23*a*.

Lift 10 is shown installed between wall mounted channels 25 that are secured to walls 21 proximate to the celing 22, and preferably is suspended from a ceiling channel 26 that is secured to approximately a mid point in the ceiling, parallel to wall channels 25, as a center support. The inclusion of ceiling channel 26 should be understood to be optional depending upon the width of the room between walls 21. The channels 25 and 26 support travel of traveling bridge 27, as will be described later herein. In practice, head 20 is arranged to travel along traveling bridge 27, across the room, moving back and forth thereon, with the traveling bridge 27 arranged to move back and forth along the wall and ceiling channels 25 and 26. Freedom of travel is thereby provided throughout the room to a handicapped person supported in sling 20 that is suspended from head 20 with vertical travel provided by a winch arrangement included with head 20 for lifting or lowering sling 12, all of which movements are controlled by the handicapped person 11 operating control box 19.

Shown in the cross sectional view of FIG. 2, the traveling bridge 27 preferably consists of an arrangement of upper and lower channels 28*a* and 28*b* that are secured together in back to back relationship as by welding, or the like, each upper and lower channel having a U-shape, with open ends thereof bent or flanged towards one another, respectively, at 28*d* and 28*c*. The lower channel flange end 28*c* and the upper channel flange end 28*d* each receive wheels of trolleys traveling therealong as will be described, or can, as shown in FIG. 2, maintain bolt 32, washer 33 and nut 34 combinations for locking the lower channels 28*b* to an end base plate 29 and the upper channel 28*a* to bridge support trolleys 30. Shown therein, each bridge support trolley 30 is mounted to a plate 31 by installation of bolts 32 through the plate 31 and through the opening formed between flanged ends 28*d* of the upper channel 28*a*. Each bolt 32 is fitted also through washer 33 and has nut 34 turned thereover. Plate 31, in turn, has secured thereto to extend normal therefrom, U-shaped yokes 35 each having axles 36 fitted through sides 35*a* thereof, which axles 36 have wheels 37 journaled on the ends thereof outside of yoke sides 35*a* for travel in channel 25 on flanged ends 25*a* thereof. Preferably, the U-shaped yoke 35 is maintained at its base 35*b* to plate 31 by fitting a bolt 38 therethrough through an appropriate hole in plate 31, which bolt has a nut 38*a* turned thereover.

Figure 8:
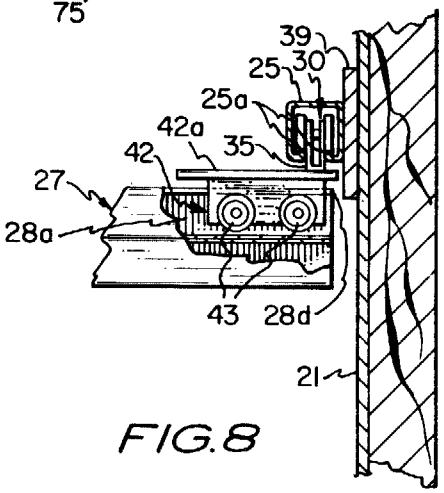
Figure 9:
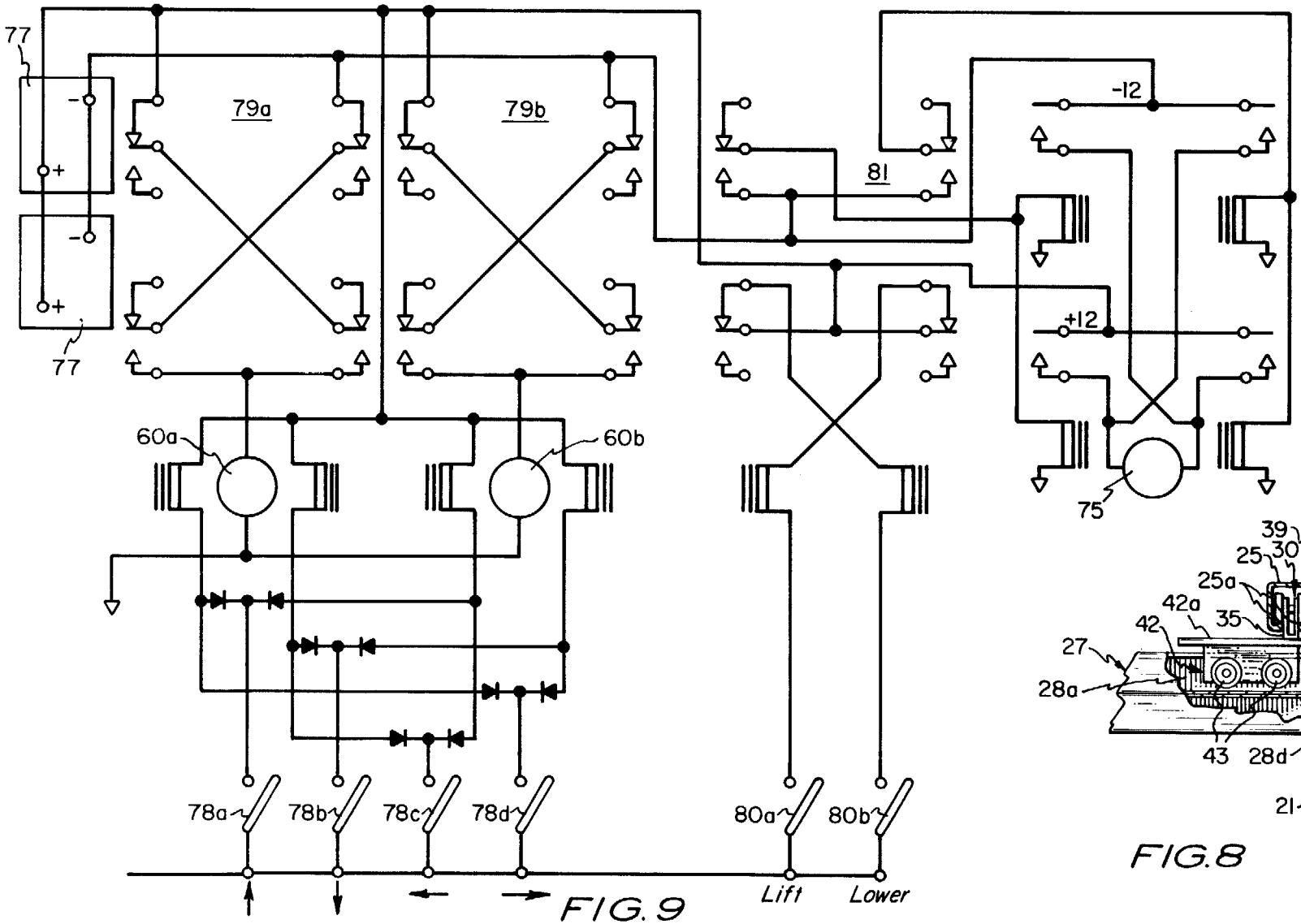

In FIG. 3, wall channel 25 is shown secured along one side 25*b* thereof to a plate 39 that is in turn secured by fasteners 40 that can be screws, bolts, or the like, to wall 21, forming thereby a rigid connection between the wall channel and wall. So arranged, the bridge support trolleys 30, attached to traveling bridge 27, roll along channel flanged ends 25*a* of the wall channel 25, between the ends thereof. Assuming that wall 21 is straight and flat where the channel 25 is attached, the above coupling arrangement would be satisfactory. However, should wall 21 be other than straight and flat, it may be necessary to provide a coupling arrangement that allows or compensates for that variation. Such an arrangement is shown in FIG. 8, where bridge support trolley 30 is shown mounted at a normal angle to a top portion 42*a* of a traveling bridge side support trolley 42 that is arranged to travel within the upper channel 28*a* of traveling bridge 27 to support that traveling bridge at its end. So arranged, as the traveling bridge moves back and forth along an uneven wall 21, side deviations are taken up by movement of the traveling bridge support trolley in upper channel 28*a*. So arranged, trolley wheels 43 of the traveling bridge side support trolley 42 provide support at the flanged ends 28*d* of upper channel 28*a* of the traveling bridge 27.

Figure 7:
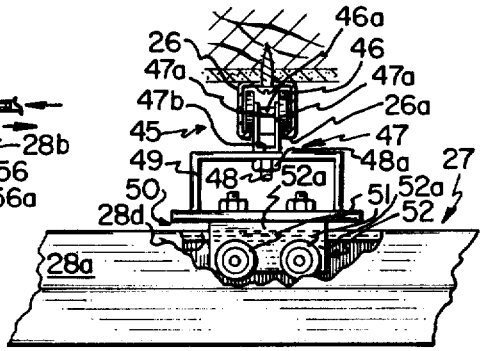

As mentioned earlier herein, additional to the trolley support of the traveling bridge 27 at its end, as described, it is preferably to also to similarly support the traveling bridge in the ceiling channel 26, as shown best in FIG. 7. Shown therein, the ceiling channel 26 is shown in cross-section containing a bridge stabilizing trolley 45 that consists of wheels 46 journaled on ends of an axle 46*a* between upright legs 47*a* of a yoke 47. The yoke 47 has a web or base 47*b* that has a fastener 48, that can be a bolt, screw, or the like, fitted therethrough with a nut 48*a* turned thereover to maintain the yoke to a box member 49. The box member 49, in turn, is connected to a bridge center support trolley 50 that has wheels 51 journaled across sides 52*a* of a yoke 52, wheels 51 supporting upper channel 28*a* of the traveling bridge 27 at the flanged ends 28*d* thereof. So arranged, bridge stabilizing trolley 45 provides for the described movement of the traveling bridge along the ceiling channel 26, with bridge center support trolley 50 compensating for any back and forth movement of traveling bridge 27 as say due to variations from a straight surface of wall 21, as described herein with respect to FIG. 8.

Figure 6:
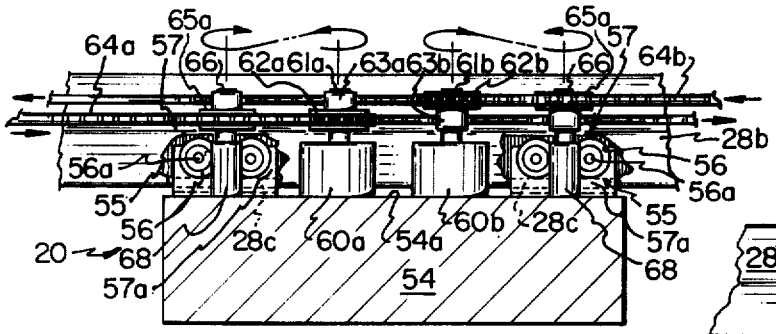

In FIG. 6 is shown a preferred arrangement of head 20 as consisting of a body 54, including and supported by head trolleys 55, one mounted on each corner thereof, that are arranged to travel along the lower channel 28*b* of traveling bridge 27. Each head trolley, like the earlier described trolleys, includes wheels 56 that are journaled on the ends of axles 56*a* between sides 57*a* of yokes 57 that are secured at their webs or bases to a top surface 54*a*. So arranged, wheels 56 travel along and within lower channel 28*b* riding on flange ends 28*c* thereof. Trolley wheels 56 are free wheeling, as are the other described trolley wheels, and support head 20 as it travels across the traveling bridge 27.

As stated hereinabove, the described trolleys 30,42,45, 50 and 55 are all essentially alike, each consisting of a U-shaped yoke, having axles with wheels journaled onto ends thereof fitted across the yoke secured appropriately to the traveling bridge or head for providing support and travel thereto. The trolley wheels preferably include appropriate bearings, or like friction reducing devices, not shown, for minimizing friction losses during travel. The present invention, rather than providing motive power to the described trolley wheels, moves traveling bridge 27 and head 20, by appropriate operation of electric motors 60*a* and 60*b*. Motors 60*a* and 60*b* are preferably identical, but each is controlled and operates independently of the other with power for operating the motors preferably supplied by a low voltage power source such as an arrangement of storage batteries that are sufficiently small and light weight so as to allow them to be included within body 54 of head 20 traveling therewith.

Shown in FIG. 6, motors 60*a* and 60*b* turn, respectively, output shafts 61*a* and 61*b* that extend therefrom, to ends of which shafts are each secured at necks 63*a* and 63*b*, respectively, sprockets 62*a* and 62*b*, respectively. The respective sprockets 62*a* and 62*b* are flip flopped from one another on shafts 61*a* and 61*b* such that they are offset from one another. Necks 63*a* and 63*b* thereof shown, respectively, and below uniformly spaces teeth that extend radially therefrom, allowing for clearance between chains 64*a* and 64*b*. Motors 60*a* and 60*b* are arranged to be turned independently in either direction, turning thereby sprockets 62*a* and 62*b* whose teeth mesh into and travel along chains 64*a* and 64*b*, respectively. Which sprocket turning, as will be shown in detail herein, provides for both movement of the head 20 along traveling bridge 27 and movement of the traveling bridge along wall channels 25. Idler sprockets 65*a* and 65*b* are provided that are journaled to shafts 66 that extend outwardly from the top 54*a* of head 54, which idler sprockets are free-wheeling and mesh also into chains 64*a* and 64*b*.

Chains 64*a* and 64*b*, as shown best in FIG. 2, are alike and preferably are, or are like, bicycle or motorcycle chains in that they are made up on interconnected pivoting links. As shown best in FIG. 4, the chains are stretched from room corner to opposite room corner at the ends of the wall channels 25, each extending across traveling bridge 27, meshing with the particular sprockets 62*a* or 62*b* and idler sprockets 64*a* and 64*b*. Shown therein, chain 64*a* extends from the "A" corner of the room formed by walls 21, across the traveling bridge 27 and through head 20 to the "C" corner of the room. Whereas, the chain 64*b* extends from the "B" corner of the room, across traveling bridge 27, and through head 20 to the "D" corner of the room. These chains can be fixed at their ends, but preferably, as shown best in FIG. 2, each has one end maintained by a spring 70 to a bracket 71 secured appropriately to the wall channel 25. The opposite chain end, as shown also in FIG. 2, is preferably fixed to a post 72 at the opposite wall channel 25 end. Spring coupling of the respective chains 64*a* and 64*b* provides for some absorption of shock, limiting jarring of a handicapped person 11 in sling 12 or damage to the motors 60*a* and 60*b*, the sprockets 62*a* and 62*b* or a chain as might occur at start up of motors 60*a* and 60*b* or when the direction of the turning of one or both motors is reversed, as will be explained in detail later herein.

To provide a ninety degree change of direction of chains 64*a* and 64*b* while maintaining them in meshing engagement to sprockets 62*a* and 62*b* and idler sprockets 65*a* and 65*b*, idler sprockets 67, as shown in FIG. 2, are provided at the end corners of the traveling bridge 27. Idler sprockets 67, like idler sprockets 65*a* and 65*b*, are free wheeling turning freely in the respective chains 64*a* or 64*b* as the motor sprockets 62*a* and 62*b* move therealong to move the traveling bridge 27 along the wall channels 25. The idler sprockets 65*a* and 65*b*, as shown in FIG. 6, journaled to posts 68 that extend upwardly from the top 54*a* of head 20 and are shown at different heights to provide for passage of one chain 64*a* and 64*b* over the other.

Figures 5A, 5B, 5C, 5D:
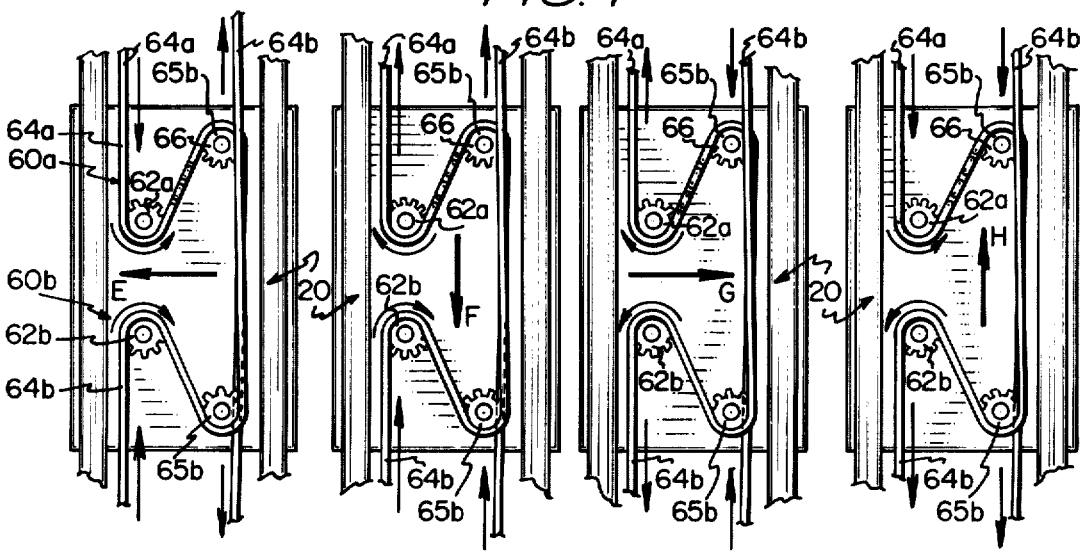

Referring to FIG. 4 and FIGS. 5(*a*) through 5(*d*), therein is shown the operation of lift 10 of the present invention with respect to movement of traveling bridge 27 and head 20. Shown in FIGS. 5(*a*) through 5(*d*), curved arrows indicate the direction of turning of motors 60*a* and 60*b* and connected sprockets 62*a* and 62*b*, with lettered straight arrows indicating the resulting direction of movement of traveling bridge 27 along wall channels 25 and travel of head 20 along the traveling bridge. Referring to FIG. 5(*a*), therein is shown sprocket 62*a* turning in a counter-clockwise direction, with sprocket 62*b* shown turning oppositely in a clockwise direction, resulting in traveling bridge 27 moving along wall channels 25 in the direction as indicated by straight arrow E, in both FIG. 5(*a*) and FIG. 4. In FIG. 5(*b*) is shown sprocket 62*a* turning in a clockwise direction, with sprocket 62*b* also turning in a clockwise direction, resulting in head 20 traveling across the traveling bridge 27 as indicated by arrow F in both FIG. 5(*b*) and FIG. 4. In FIG. 5(*c*) is shown sprocket 62*a* turning in a clockwise direction with sprocket 62*b* turning in a counter-clockwise direction, resulting in the traveling bridge 27 moving along the wall channels 25 in the direction indicated by arrow G in both FIG. 5(*c*) and FIG. 4. In FIG. 5(*d*) is shown sprocket 62*a* turning in a counter-clockwise direction with sprocket 62*b* turning also in a counter-clockwise direction, resulting in head 20 traveling across traveling bridge 27, as indicated by arrow H in both FIG. 5(*d*) and FIG 4. As shown in FIGS. 5(*a*) through 5(*d*), and as described hereinabove, by turning motors 60*a* and 60*b* so as to turn sprockets 62*a* and 62*b* oppositely, as shown in FIG. 5(*a*) and FIG. 5(*c*), traveling bridge 27 will move along wall channels 25 in the direction of arrows E or G. Whereas, by turning motors 60*a* and 60*b* so as to turn sprockets 62*a* and 62*b* in the same direction, as shown in FIG. 5(*b*) and 5(*d*), the head 20 will be moved along traveling bridge 27 in the direction of arrows F or H. With, as described hereinabove, chains 64*a* and 64*b* secured in stationary attitudes, movement of the traveling bridge or head will be provided by the sprockets 62*a* and 62*b* turning and traveling along those chains.

The present invention, while utilizing only two motors, provides for movement in four directions in a horizontal plane to a handicapped person 11 suspended in sling 12 from head 20. Vertical movement of the handicapped person 11 in sling 12, as shown best in FIG. 1, is preferably provided by turning of an electric motor 75 through a transmission 75*a*, to turn a shaft 75*b* that has a pulley 76 secured thereon to reel in or reel out cable 17 that is attached to sling 12 with handicapped person 11 thereon. While not shown, it should be understood that motor 75 and transmission 75*a* preferably include a braking arrangement therewith, whereby, should power be removed from that motor, shaft 75*b* will be restrained from turning, locking the cable 17 extending from pulley 76 in place, prohibiting sling 12 with handicapped person 11 therein from rapidly descending to the floor of the room.

The handicapped person 11, as shown best in FIG. 1, preferably controls operation of the respective motors, 60*a*, 60*b* and 75 at control box 19. This control box is preferably operated by buttons whereby, the handicapped person can appropriately depress select buttons 78*a*, 78*b*, 78*c*, 80*a* and/or 80*b*, that are shown best in FIG. 7, to control motor operation so as to provide him with three dimensions of travel within the confines of walls 21 and walls of FIG. 1.

In the schematic of FIG. 7, mentioned hereinabove, additional to buttons 78*a* through d and 80*a* and 80*b*, are shown electrical motors 60*a*, 60*b* and 75 and representations of switches and current paths through the buttons from batteries 77 to operate these motors. Shown therein, switches 78*a* through 78*d*, respectively, control routing of power from batteries 77 to turn each motor in either a clockwise or counter-clockwise direction to provide the desired direction of travel of traveling bridge 27 or head 20 as shown and described with repect to FIGS. 5(*a*) through 5(*d*). Buttons 78*a* through 78*d* when appropriately energized, close appropriate switches in blocks 79*a* and 79*b* to provide a voltage path to either one side or the other of an electrical motor 60*a* and 60*b*. Voltage from batteries 77 is shown in FIG. 7 to also travel through buttons 80*a* and 80*b* to motor 75 with operation thereof providing for a lifting or lowering of handicapped person 11 in sling 12, as has been described. Operation of buttons 80*a* and 80*b*, respectively, provides for appropriate switching as shown at 81 in FIG. 7 of power to one side or the other of motor 75. FIG. 7 shows motor 75 as preferably being connected so as to operate on a 12-volt differential. Motors 60*a* and 60*b* are shown arranged in a parallel connection to batteries 77, whereas motor 75 is shown arranged in the series connection with both batteries 77.

While the above electrical connection arrangement is preferred, it should be obvious that other arrangements and other power sources could be incorporated with the present invention without departure from the subject matter coming within the scope of this disclosure.

Preferably, the present invention involves a low voltage power supply as a safety precaution against handicapped person 11 receiving a dangerous electrical shock should the control box 19, or the like, come in contact with or be immersed in water. While such low voltage arrangement is preferred, it should be obvious that another voltage arrangement or even wall current could be used as a power source without departure from the subject matter coming within the scope of this disclosure. Further, while not shown, it should be understood that the present invention can include an arrangement for charging of batteries 77, which arrangement could be a conventional transformer for connection into a wall socket, feeding power into the batteries for storage, or could involve an induction system where no direct connection of the batteries 77 to a wall current is provided that is also not shown.

While a preferred embodiment of the present invention in a three dimensional lift has been shown and described herein, it should be understood that the present disclosure is made by way of example and that variations are possible without departing from the subject matter coming within the scope of the following claims, which claims we regard as our invention.

We claim:

1. A three dimensional lift comprising, a traveling bridge arranged to span between opposite sides of a room;

channel means secured appropriately in said room for supporting said traveling bridge at its ends such that it can move therealong;

trolley means secured to the ends of said traveling bridge arranged to travel along said channel means for supporting said traveling bridge as it travels along said channel means;

a head arranged to travel back and forth on said traveling bridge;

trolley means secured to said head and arranged with said traveling bridge so as to travel therealong;

two chain means each secured at its ends to opposite ends of the channel means and passes across said traveling bridge, said chain means crossing each other at said head;

two motor means each secured to said head, each having a sprocket means turned thereby, each sprocket means meshing into, to travel along, one of said chain means;

a hoist motor means arranged with said head for turning a pulley means;

a sling means for supporting a handicapped person;

a cable means attached to said sling means and said pulley means;

means for providing power to said two motor means and hoist motor means; and control means for controlling operation of said two motor means and hoist motor means.

2. A three dimensional lift as recited in claim 1, wherein the traveling bridge consists of a pair of U-shaped double channels that are secured in back to back relationship, said double channels maintained equidistantly spaced apart; and plate means secured across said double channel ends for maintaining said equidistantly spaced apart double channels.

3. A three dimensional lift as recited in claim 2, wherein the open ends of the U-shaped channel sides are flanged inwardly.

4. A three dimensional lift as recited in claim 3, wherein the trolley means secured to said head consists of, a yoke secured at its base to said head having an axle secured between upright sides thereof, said axle maintaining wheels journaled thereon that are arranged in a lower channel of the double channel said wheels rolling along the inwardly flanged ends thereof.

5. A three dimensional lift as recited in claim 1, wherein the channel means secured appropriately in said room each consist of U-shaped channels each secured along one upright side to opposite room walls, the ends of said upright sides facing towards the room floor and flanged inwardly towards one another; and the trolley means secured to the traveling bridge ends consists of, a yoke secured at its base to said traveling bridge end having an axle secured between upright sides thereof, said axle maintaining wheels journaled thereon that are each arranged in said U-shaped channel rolling along said inwardly flanged ends thereof.

6. A three dimensional lift as recited in claim 1, further including flexible coupling means for securing one end of each chain means to one of the channel means.

7. A three dimensional lift as recited in claim 6, wherein the flexible coupling means is a spring secured at its one end to a chain means end and at its other end to the channel means.

8. A three dimensional lift as recited in claim 1, wherein each motor means is an electrical motor capable of clockwise and counterclockwise turning.

9. A three dimensional lift as recited in claim 8, wherein the means for providing power to operate each motor means is a storage battery.

10. A three dimensional lift as recited in claim 9, wherein each of the motor means is operated from a twelve volt battery source.

11. A three dimensional lift as recited in claim 1, further including idler sprocket means arranged with said traveling bridge, each idler sprocket means meshing with one of the chain means, supporting said chain means as it makes a ninety degree band between said traveling bridge and the channel means.

12. A three dimensional lift as recited in claim 1, further including idler sprocket means arranged with said head, each idler sprocket means meshing with one of the chain means, for maintaining said chain means against the sprocket means turned by one of the motor means.

13. A three dimensional lift as recited in claim 1, wherein the sprocket means are conventional sprocket gears having uniformly spaced teeth extending radially therefrom; and the chain means consist of individual links pivotally coupled end to end, each link formed such that a sprocket gear tooth can freely pass therein.

14. A three dimensional lift as recited in claim 11, wherein the sprocket means each turned by one of the two motor means are off-set with respect to one another such that said chain means can cross over one another at the head.

15. A three dimensional lift as recited in claim 1, wherein the hoist motor means is a conventional electric motor.

16. A three dimensional lift as recited in claim 15, wherein the means providing power to the hoist motor means is a storage battery.

17. A three dimensional lift as recited in claim 16, wherein, the hoist motor means is operated from a twenty four volt battery source.

18. A three dimensional lift as recited in claim 1, further including, a transmission operated by the hoist motor means; and an output shaft from said transmission connection to the pulley means and turned by said transmission.

19. A three dimensional lift as recited in claim 1, wherein, the sling means includes a trapeze bar supporting a sling portion thereof and connects, at a center thereof to the cable means; and means for connecting said cable means to said trapeze bar center.

20. A three dimensional lift as recited in claim 1, wherein the control means consists of a control suspended from the head convenient to a handicapped person arranged in the sling means; and means associated with said control for switching power therethrough appropriately to the motor means and hoist motor means.

21. A three dimensional lift as recited in claim 20, wherein the switching means is operated from a low voltage source.

* * * * *